US009568858B2

(12) United States Patent
Oda

(10) Patent No.: US 9,568,858 B2
(45) Date of Patent: Feb. 14, 2017

(54) DEVELOPING UNIT, IMAGE FORMING UNIT, AND IMAGE FORMING APPARATUS

(71) Applicant: Oki Data Corporation, Tokyo (JP)

(72) Inventor: Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/680,688

(22) Filed: Apr. 7, 2015

(65) Prior Publication Data

US 2015/0293476 A1 Oct. 15, 2015

(30) Foreign Application Priority Data

Apr. 10, 2014 (JP) ..... 2014-081283

(51) Int. Cl.
*G03G 15/08* (2006.01)

(52) U.S. Cl.
CPC ..... *G03G 15/0891* (2013.01); *G03G 15/0839* (2013.01); *G03G 15/0877* (2013.01)

(58) Field of Classification Search
CPC ..... G03G 15/0839; G03G 15/0877; G03G 15/0886; G03G 15/0889; G03G 15/0891
USPC ..... 399/256, 260
See application file for complete search history.

(56) References Cited

U.S. PATENT DOCUMENTS

2004/0057755 A1* 3/2004 Yamaguchi ..... G03G 15/0877 399/256
2007/0077096 A1* 4/2007 Otani ..... 399/258
2008/0145109 A1* 6/2008 Murayama et al. ..... 399/260
2012/0189350 A1* 7/2012 Kubota et al. ..... 399/254
2013/0223856 A1 8/2013 Koyama et al.

FOREIGN PATENT DOCUMENTS

JP 2007-101718 A 4/2007

* cited by examiner

*Primary Examiner* — Benjamin Schmitt
(74) *Attorney, Agent, or Firm* — Rabin & Berdo, P.C.

(57) ABSTRACT

A developing unit includes a chamber in which a developer material is held. The developer material is received from an external device through the developer material receiving opening. A developer guide member is disposed in the chamber and directly under the developer material receiving opening. The developer guide member extends in a first direction and guides the developer material in the first direction. A developer material transporting member is disposed between the developer material receiving opening and the developer guide member. The developer material transporting member extends in a second direction parallel to the first direction and transports the developer material in the second direction. An agitator is formed on the developer transporting member and is disposed directly under the developer material receiving opening.

15 Claims, 13 Drawing Sheets

DEVELOPING UNIT, IMAGE FORMING UNIT, AND IMAGE FORMING APPARATUS

BACKGROUND OF THE INVENTION

Field of the Invention

The present invention relates to an image forming apparatus such as electrophotographic printing apparatus, and more particularly to an image forming unit incorporated in the image forming apparatus.

Description of the Related Art

An electrophotographic process is used in conventional image forming apparatus including electrophotographic printers, copying machines, and facsimile machines. The surface of a photoconductive body is uniformly charged. The charged surface is irradiated with light in accordance with print data to form an electrostatic latent image. Toner is supplied to the electrostatic latent image to develop the electrostatic latent image into a toner image. The toner image is then transferred onto paper. The toner image on the paper is then fixed into a permanent image under heat and pressure.

Japanese Patent Application Laid-Open No. 2007-101718 (see Page 6, FIG. 4) discloses one such image forming apparatus. A conventional image forming apparatus includes a toner cartridge that holds toner therein, and a developing unit that supplies the toner to an electrostatic latent image formed on a photoconductive body to develop the electrostatic latent image into a toner image. The toner cartridge and developing unit have openings, respectively. The toner is supplied through the openings from the toner cartridge into the developing unit.

A toner transporting means is located under the opening of the developing unit. The toner transporting means includes a toner guide that guides the toner and a transporting spiral that transports the toner along the toner guide in opposite directions with respect to the receiving opening, so that a fraction of the toner falls into the developing unit as the toner is advanced along the toner guide. As a result, the toner is distributed in the developing unit substantially uniformly along the toner guide.

The above-described toner transporting means suffers from a problem in that the toner in the vicinity of the openings may agglomerate, being an obstacle to smooth supply of toner from the toner cartridge in to the developing unit.

SUMMARY OF THE INVENTION

The present invention was made to solve the aforementioned drawbacks.

An object of the invention is to provide smooth supply of a developer material.

A developing unit includes a chamber in which a developer material is held. The developer material is received from an external device through the developer material receiving opening. A developer guide member is disposed in the chamber and directly under the developer material receiving opening. The developer guide member extends in a first direction and guides the developer material in the first direction. A transporting member is disposed between the developer material receiving opening and the developer guide member. The transporting member extends in a second direction parallel to the first direction and transports the developer material in the second direction. An agitator is formed on the transporting member and is disposed directly under the developer material receiving opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and wherein.

DETAILED DESCRIPTION OF THE INVENTION

The present invention will be described in detail by way of preferred embodiments with reference to the accompanying drawings.

First Embodiment

Figure 1:
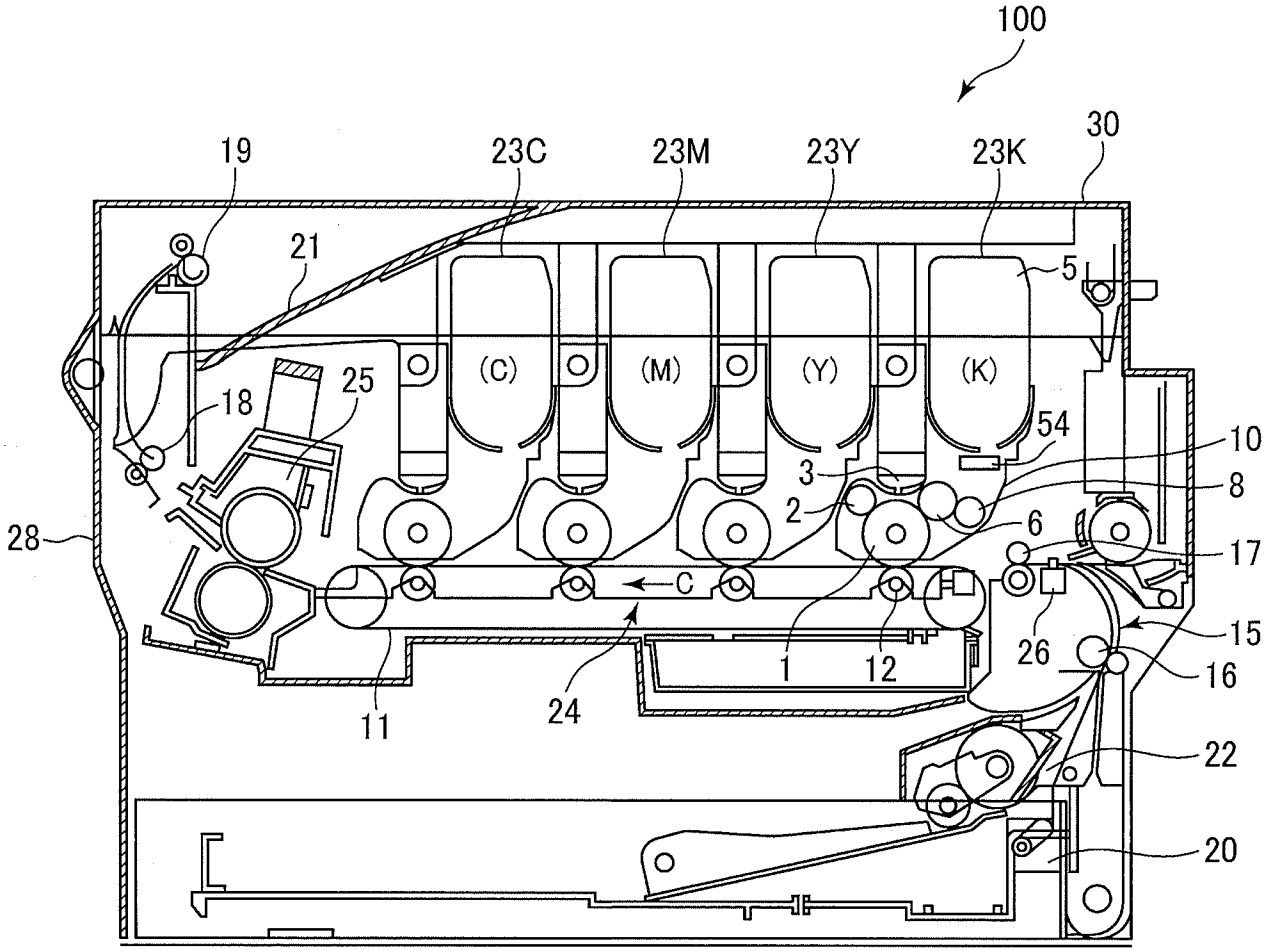
FIG. 1 illustrates the outline of an image forming apparatus according to a first embodiment of the invention.

FIG. 1 illustrates the outline of an image forming apparatus 100 according to a first embodiment of the invention.

The image forming apparatus 100 is a color electrophotographic printer capable of forming black (K), yellow (Y), magenta (M) and cyan (C) images. A lower frame 28 accommodates a generally S-shaped transport path 15 along which transport rollers 16-19 are disposed. A paper cassette 20 is located at an upstream end of the transport path 15. A stacker 21 is disposed at a downstream end of the transport path 15.

A paper feeding section 22 is located at an upstream end of the transport path 15, and feeds recording paper from the paper cassette 20 on a sheet-by-sheet basis. A detector 26 is disposed immediately upstream of a registry roller 17 and detects the thickness of the recording paper. A transfer belt unit 24 is located immediately downstream of the registry roller 17, and includes a transfer belt 11. The recording paper is electrostatically attracted to the transfer belt 11. A fixing unit 25 is disposed at a downstream end of the transfer belt 11.

Image forming units 23K, 23Y, 23M, and 23C, which form black, yellow, magenta, and cyan images, respectively, are aligned in that stated order along the transfer belt 11 such that the recording paper on the transfer belt 11 is sandwiched between the transfer belt unit 24 and the image forming units 23K, 23Y, 23M, and 23C. The image forming units 23K, 23Y, 23M, and 23C are detachably attached to the body of the image forming apparatus 100.

When any one of the image forming units 23K, 23Y, 23M, and 23C, the fixing unit 25, and the transfer belt unit 24 needs to be replaced, a top cover 30 is opened and is replaced by a new, unused one.

The image forming units 23K, 23Y, 23M, and 23C are identical and differ only in the color of developer material. Therefore, the description thereof will be confined to the image forming unit 23K, it being understood that the image forming units 23K, 23Y, 23M, and 23C are identical in construction.

Figure 2:
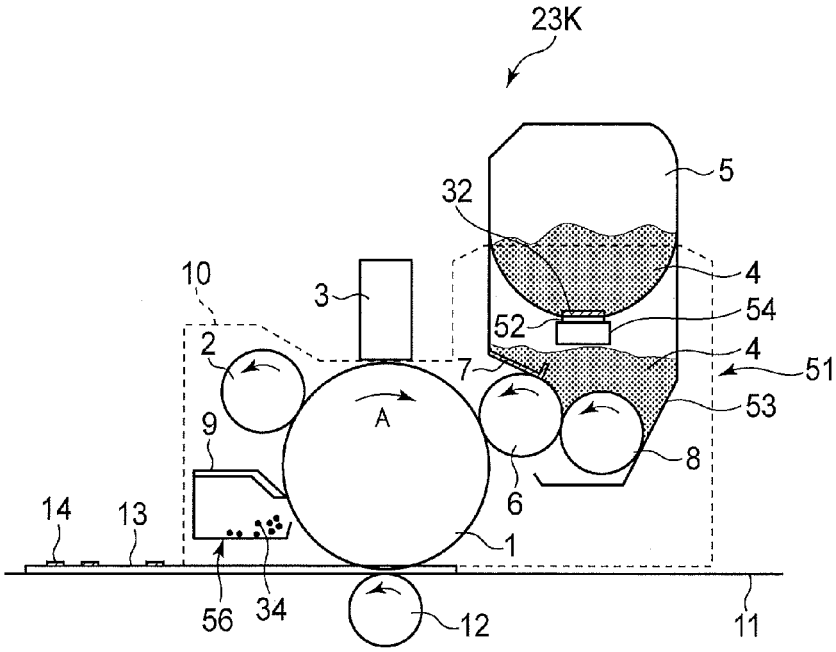
FIG. 2 illustrates the outline of an image forming unit for forming black images.

FIG. 2 illustrates the outline of the image forming unit 23K for forming black images. The image forming unit 23K includes the transfer belt 11, a transfer roller 12, an exposing unit 3, and a sheet of recording paper 13.

A photoconductive body 1 is rotatable in a direction shown by arrow A. A charging roller 2, the exposing unit 3, a developing unit 51, the transfer roller 12, and a cleaning blade 9 are disposed to surround the photoconductive body 1 from upstream to downstream with respect to rotation of the photoconductive body 1. The charging roller 2 rotates in contact with the surface of the photoconductive body 1, and uniformly charges the surface. The exposing unit 3 includes a light source (e.g., LEDs) that illuminates the charged surface of the photoconductive body 1 to form an electrostatic latent image. The exposing unit 3 is mounted on the top cover 30 (FIG. 1).

The developing section 51 supplies the black developer material to the electrostatic latent image formed on the photoconductive body 1, thereby developing the electrostatic latent image into a black toner image. The cleaning blade 9 is formed of an elastic body, and has an edge in pressure contact with the surface of the photoconductive body 1. When the photoconductive body 1 rotates, the cleaning blade 9 scrapes the residual toner 34, which remains on the surface of the photoconductive body 1 after transferring the toner image onto the recording paper. The scraped toner falls onto a waste toner collecting section 56. The photoconductive body 1, the charging roller 2, a developing roller 6, and the transfer roller 12 are driven in rotation by a drive source (not shown) via, for example, a train of gears.

The developing unit 51 includes the toner cartridge 5, a toner chamber (chamber) 53, the developing roller 6, and a developing blade 7. The toner cartridge 5 discharges toner 4 through an toner discharging opening 32 formed in the bottom of the toner cartridge 5. The toner chamber 53 has a rectangular toner receiving opening 52 formed therein, and receives the toner from the toner cartridge 5. The toner chamber 53 holds toner 4 as a developer material therein. The developing roller 6 as a developer material bearing body is in pressure contact with the photoconductive body 1, and supplies the toner to the electrostatic latent image formed on the photoconductive body 1. A developer supplying roller 8 supplies the toner to the developing roller 6. The developing blade 7 forms a thin layer of toner 4 on the surface of the developing roller 6. A toner distributor 54 distributes the toner 4, which falls into the toner chamber 53, in a longitudinal direction in which the toner chamber 53 extends.

The toner cartridge 5 is detachably attached on the body 23*a* of the image forming unit 23K so that the toner cartridge 5 is over the toner supplying roller 8. The body 23*a* is molded from a plastic material, and serves as a housing 10 in which the respective structural elements are accommodated.

The developing roller 6 parallels the toner supplying roller 8, and is in pressure contact with the toner supplying roller 8. The developing roller 6 and toner supplying roller 8 rotate in the same direction as shown in FIG. 2. The bent portion of the developing blade 7 contacts the circumferential surface of developing roller 6 under pressure, and extends parallel with the developing roller 6. The developing roller 6, supplying roller 8, and photoconductive body 1 are driven by a drive source (not shown) via a gear train or the like.

The transfer roller 12 is formed of a rubber material, and is in pressure contact with the photoconductive body 1 so that when the recording paper 13 is transported through the image forming section 23K, the recording paper 13 is sandwiched between the transfer belt 11 and the photoconductive body 1. The transfer roller 12 serves to transfer the toner image onto the recording paper 13. Before the toner image is transferred onto the recording paper 13, a voltage is applied to the transfer roller 12 to create an electric field between the photoconductive body 1 and the transfer roller 12, so that the toner image is transferred onto the recording paper 13 by the Coulomb force.

The fixing unit 25 includes a heat roller and a back-up roller. When the recording paper 13 with the toner image thereon passes through the gap formed between the heat roller and back-up rollers, the toner image is fixed into a permanent image under heat and pressure. The heat roller and back-up roller cooperate with each other to hold the recording paper 13 therebetween in a sandwiched relation, and advance the recording paper 13 toward the stacker 21.

A description will be given of the image forming unit 23K according to the first embodiment.

Figure 3:
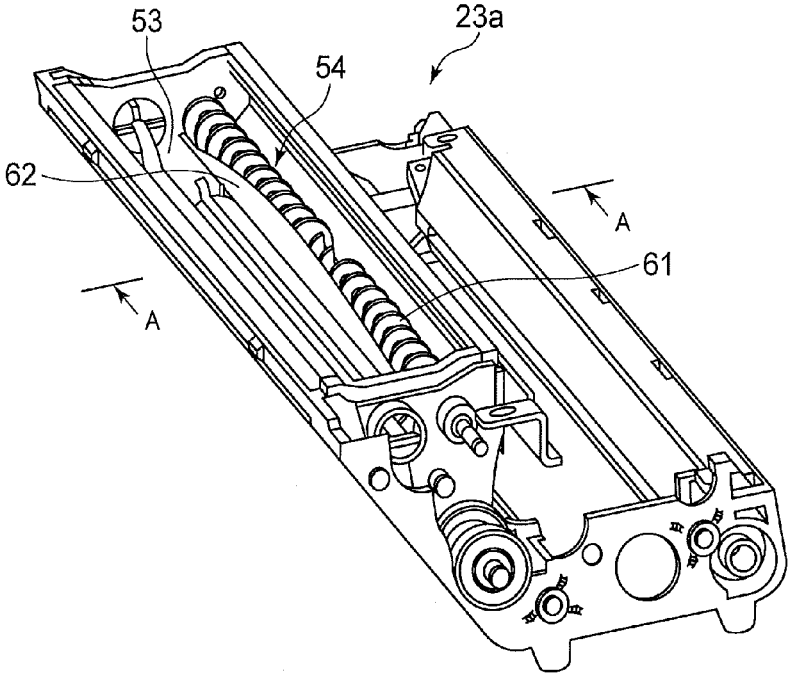
FIG. 3 is a perspective view of a body of the image forming unit when a toner cartridge has been detached from the body.
Figure 4:
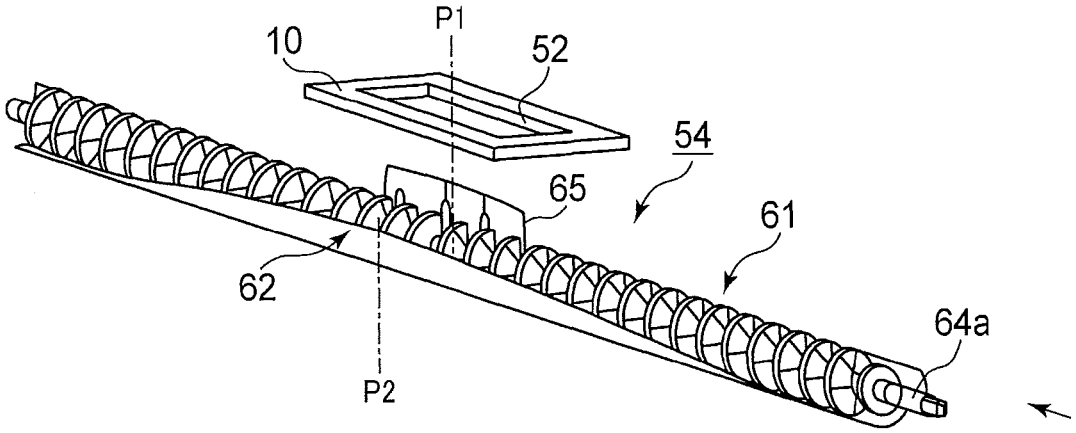
FIG. 4 is a perspective view, illustrating the positional relationship between a toner receiving opening formed in the body and a toner distributor disposed in the body.
Figure 5:
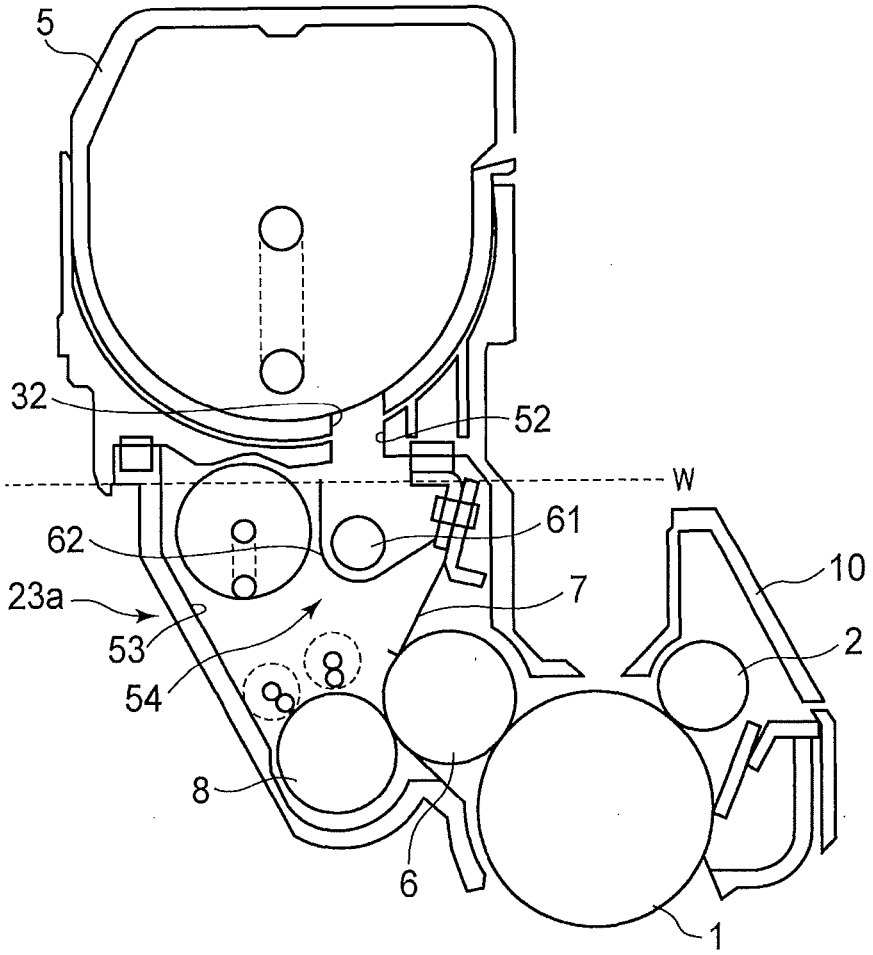
FIG. 5 is a cross-sectional view of the image forming unit taken along a line A-A in FIG. 3.

FIG. 3 is a perspective view of the body 23*a* of the image forming unit 23K when the toner cartridge 5 has been detached from the body 23*a*. FIG. 4 is a perspective view, illustrating the positional relationship between the toner receiving opening 52 formed in the body 23*a* and the toner distributor 54 disposed in the body 23*a*. FIG. 5 is a cross-sectional view of the image forming unit 23K taken along a line A-A in FIG. 3. FIG. 3 illustrates a portion of FIG. 5 below a dotted line W in FIG. 5.

Referring to FIGS. 3, 4, and 5, the body 23*a* includes a portion that receives the toner cartridge 5 and has the toner receiving opening 52 formed therein. Once the toner cartridge 5 has been received in the portion, the toner receiving opening 52 is in alignment with the toner discharging opening 32. The toner discharging opening 32 is formed in the toner cartridges 5, and the toner receiving opening 52 is formed in the shape of a rectangle which has long sides extending in directions parallel to a direction in which the cartridge 5 extends. The toner chamber 53 defined in the body 23*a* receives the toner 4 from the toner cartridge 5 through the opening 52.

The toner distributor 54 is under the toner receiving opening 52, and extends in a direction parallel to the direction in which the toner chamber 53 extends. The middle portion of the toner distributor 54 is located directly under the toner receiving opening 52. Referring to FIG. 5, the toner distributor 54 is located in the toner chamber 53. The toner distributor 54 is between the toner receiving opening 52 and the developer supplying roller 8, and is in the vicinity of the toner receiving opening 52. The toner distributor 54 includes a toner guide (guide member) 62 and a toner transporting spiral (transporting member) 61. The toner guide 62 temporarily receives the toner 4 falling from the toner receiving opening (receiving opening) 52. The toner transporting spiral 61 transports the toner on the toner guide 62 along the toner guide 62 toward the longitudinal ends of the toner guide 62. The toner transporting spiral 61 includes a toner agitator 65 (agitator) (FIGS. 7A and 7B) mounted on the middle portion of the toner transporting spiral 61.

Figure 6:
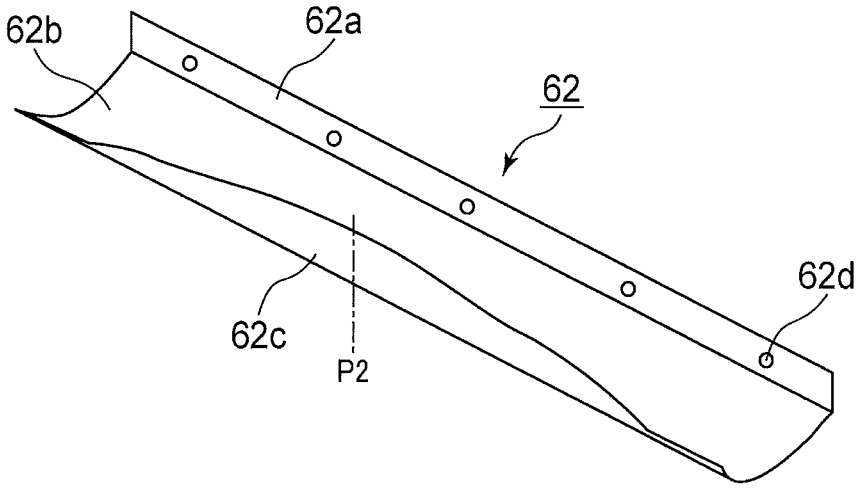
FIG. 6 is a perspective view of a toner guide.

FIG. 6 is a perspective view of the toner guide 62. The toner guide 62 is mounted on the body 23*a* at a plurality of mounting holes 62*d*, extending in a direction parallel to the rotational axis of the photoconductive body 1. The toner guide 62 is in a single piece construction, and includes a bottom 62*b* that supports the toner 4 thereon, a wall 62*a* that rises from the bottom 62*b*. The bottom 62*b* includes a portion that extends substantially circumferentially around the toner transporting spiral 61, and includes a toner barrier wall 62*c*. The toner barrier wall 62*c* is contiguous with the bottom 62*b* and extends circumferentially, partially covering the toner transporting spiral 61. The bottom 62*b* receives at its longitudinally middle potion the toner 4 that falls from the toner receiving opening 52.

The barrier wall 62*c* is on a side of the toner guide 62 opposite the wall 62*a*, and extends substantially vertically from the bottom 62*b*. The height of the barrier wall 62*c* is highest in the vicinity of a longitudinally mid-point P of the toner transporting spiral 61, and decreases nearer the longitudinal ends of the bottom 62*b*. The barrier wall 62*c* may circumferentially extend, partially covering the toner transporting spiral 61.

Figure 7A:
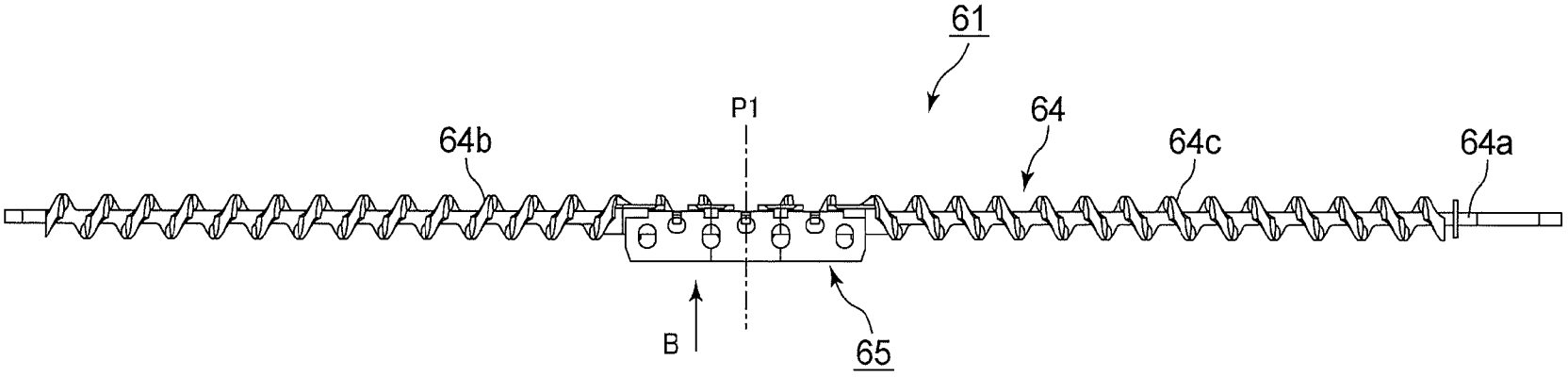
FIG. 7A is a top view of a toner transporting spiral as seen in a direction normal to a major surface of a middle portion.
Figure 7B:
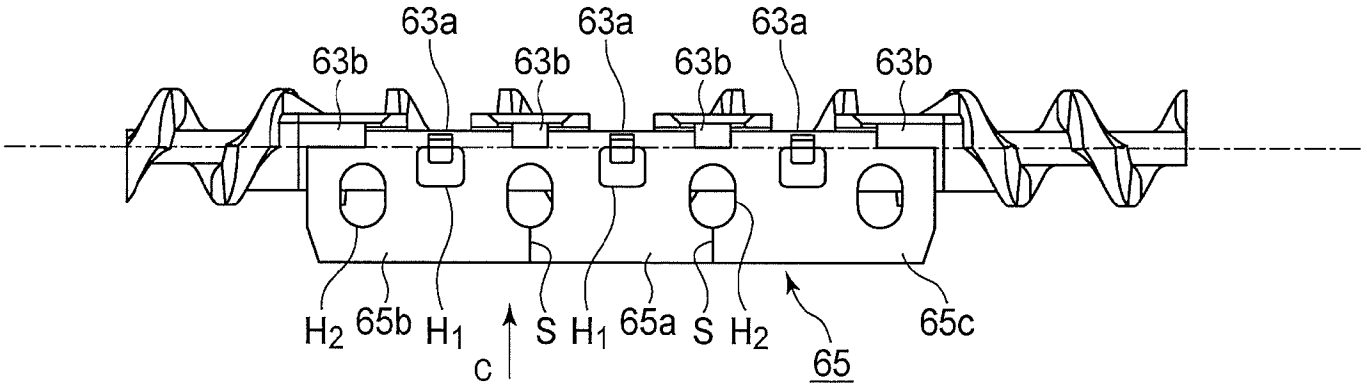
FIG. 7B is a partial expanded view of the toner guide and the middle portion of a toner agitator.
Figure 8A:
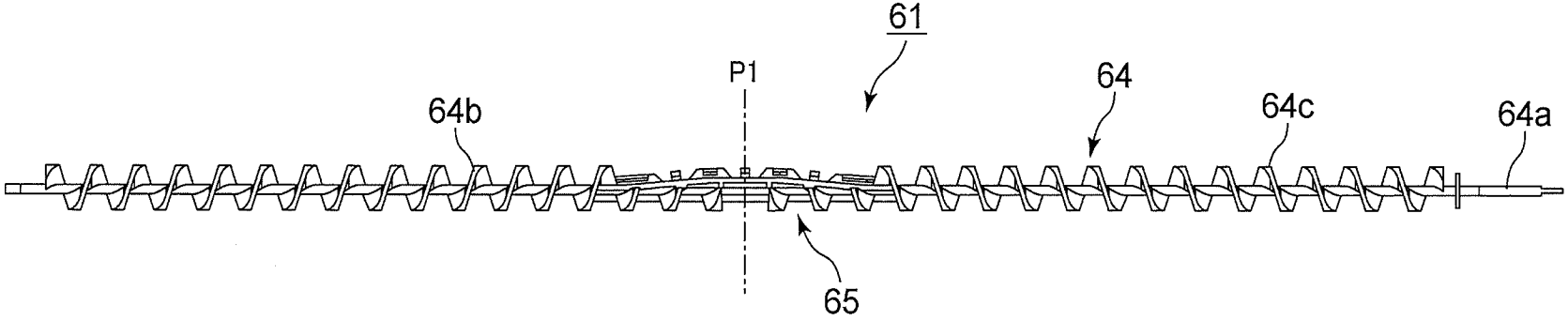
FIG. 8A is a top view as seen in a direction shown by arrow B in FIG. 7A.
Figure 8B:
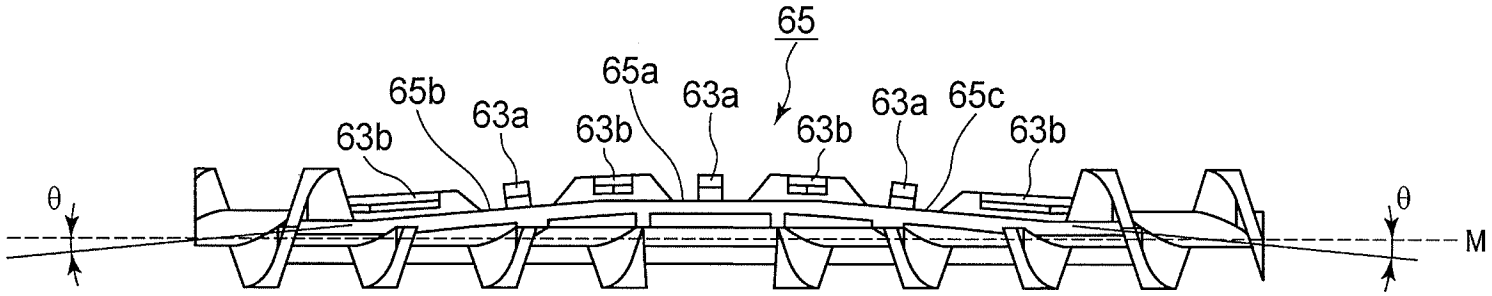
FIG. 8B is an expanded view of a pertinent portion in FIG. 7B.

FIG. 7A is a top view of the toner transporting spiral 61 as seen in a direction normal to a major surface of the middle portion 65*a*. FIG. 7B is a partial expanded view of the toner guide 62 and the middle portion of the toner agitator 65. FIG. 8A is a top view as seen in a direction shown in by arrow B in FIG. 7A. FIG. 8B is an expanded view as seen in a direction shown by arrow C in FIG. 7B.

Referring to FIGS. 7A, 7B, 8A, and 8B, the toner transporting spiral 61 includes a shafted spiral screw 64 and the toner agitator 65. The shafted spiral screw 64 includes a shaft 64*a*, a left-turn spiral 64*b* and a right-turn spiral 64*c*. The left-turn spiral 64*b* and right-turn spiral 64*c* serve as developer material transporting members. The toner agitator 65 is fixedly mounted on the middle portion of the shafted spiral screw 64, and serves as a developer agitating member.

The right-turn spiral 64*b* and left-turn spiral 64*c* extend in opposite directions with respect to the longitudinal mid-point P of the toner transporting spiral 61, so that when the shafted spiral screw 64 rotates in a predetermined direction, the left-turn spiral 64*b* moves the toner 4 toward one of the longitudinal opposed ends of the toner guide 62, and the right-turn spiral 64*c* moves the toner 4 toward the other of longitudinal opposed ends.

Referring to FIG. 7B, the toner agitator 65 includes the middle portion 65*a* and slanted portions 65*b* and 65*c* with the middle portion 65*a* positioned between the slanted portions 65*b* and 65*c*. The middle portion 65*a* and slanted portions 65*b* and 65*c* can flex independently. The toner agitator 65 is fixedly mounted on the shafted spiral screw 61 so that the middle portion 65*a* is in alignment with the mid-point P or the toner agitator 65 is assembled to the shafted spiral screw 64 in a laterally centered position, being firmly sandwiched between the shafted spiral screw 61 and mounting portions 63*b*. The toner agitator 65 is formed with the holes H1 through which hook-like mounting portions 63*a* engage with the toner agitator 65. Although the shafted spiral screw 64 and the toner agitator 65 have been described as separate components, they may be formed in a single piece construction.

As shown in FIG. 8B, the middle portion 65*a* lies in a plane parallel to a rotational axis M of the shaft 64*a* of the shafted spiral screw 64. The slanted portions 65*b* and 65*c* extend from the middle portion 65*a* to the rotational axis M to form an angle θ with the rotational axis M. The middle portion 65*a* and slanted portions 65*b* and 65*c* are aligned in a direction substantially parallel to the rotational axis M with the middle portion 65*a* positioned between the slanted portions 65*b* and 65*c*, the slanted portions 65*b* and 65*c* extending away from the middle portion 65*a* in opposite directions. Thus, each of the slanted portions 65*b* and 65*c* approaches the toner transporting spiral (developer transporting member) 61 with increasing distance from the middle portion 65*a*. The angle θ is selected to be in the range of 4 to 6 degrees, preferably 5 degrees. Thus, the toner agitator 65 is symmetrical with respect to a plane passing through the mid-point P and perpendicular to the rotational axis M. In other words, the toner agitator 65 has two halves that are mirror images of each other with respect to a plane passing through the mid-point P and perpendicular to the rotational axis M.

The toner transporting spiral 61 is accommodated in the toner chamber 53 (FIG. 5) and is rotatably supported by the body 23*a*. It is to be noted that the toner transporting spiral 61 extends to the longitudinal ends of the toner chamber 53.

Referring to FIG. 4, the toner transporting spiral 61 is positioned so that the mid-point P is in alignment with the toner receiving opening 52. The toner guide 62 is located under the toner transporting spiral 61 and is close to the toner transporting spiral 61.

Figure 12A:
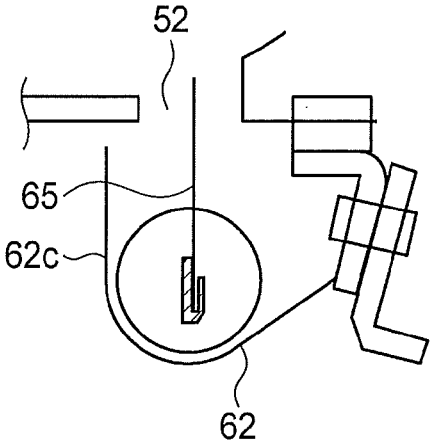
FIGS. 12A and 12B illustrate the operation of the toner agitator.
Figure 12B:
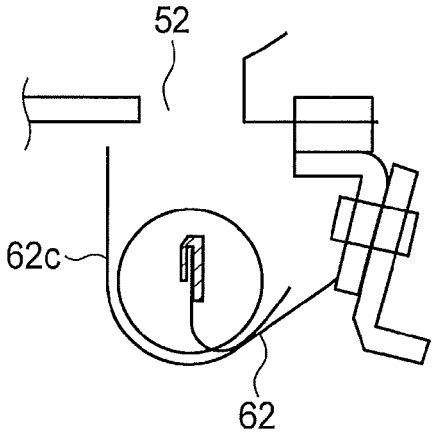

The toner agitator 65 includes a flexible, resilient member (e.g., polyester film) having a 0.1 mm thickness, the polyester film extending from the base portion so that when the flexible member is directly under the toner receiving opening 52 or lies in a projected area of the receiving opening 52, the polyester film extends into the receiving opening 52 (FIGS. 12A and 12B). The toner agitator 65 has a width that is slightly smaller than the longitudinal length of the toner receiving opening 52 so that the toner agitator is in the projected area of the toner receiving opening 52. When the toner agitator 65 rotates, the resilient member is resiliently deformed and strokes the inner wall of the toner chamber 53 and the surface of the toner guide 62. The toner agitator 65 may be formed of a single polyester film with cuts S or slits a fraction of the way through it (preferably except for base portions fixed to the toner transporting spiral 61), defining the middle portion 65*a*, slanted portion 65*b*, and slanted portion 65*c*. The toner agitator 65 may also have holes H1 and 112 as shown in FIG. 7B. Alternatively, the middle portion 65*a*, slanted portion 65*b*, and slanted portion 65*c* may be independent films disposed with a small gaps therebetween.

The left-turn spiral 64*b* and right-turn spiral 64*c* extend to the vicinity of the mid-point P, so that part of the left-turn spiral 64*b* and right-turn spiral 64*c* is behind the toner agitator 65. However, since the toner agitator 65 is mounted on the toner transporting spiral 61, the shape of the spiral behind toner agitator 65 is incomplete and therefore the ability of the incomplete spiral shape to transport the toner along the toner guide 62 is not sufficient in the vicinity of the mid-pint P.

With reference to FIG. 1, a description will be given of the overall printing operation of the image forming apparatus 100.

When a printing operation is started, the paper feeding section 22 feeds the recording paper from the paper cassette 20 into the transport path 15 on a sheet-by-sheet basis. The recording paper is transported along the transport path 15. When the recording paper passes the detector 26, the detector detects the thickness of the recording paper. The recording paper is further transported by the transfer belt unit 24 in a direction shown by arrow C. As the recording paper passes through the image forming units 23K, 23Y, 23M, and 23C in sequence, images of corresponding colors are transferred onto the recording paper in registration to forma full color toner image. The recording paper is then advanced into the fixing unit 25 where the toner image is fixed into a permanent color. After fixing, the recording paper is discharged onto the stacker 21.

The operation of the image forming units 23K, 23Y, 23M, and 23C will be described with reference to FIG. 2.

The description will be confined to image forming unit 23K, it being understood that the image forming units 23K, 23Y, 23M, and 23C are identical in construction.

The charging roller 2 uniformly charges the surface of the photoconductive body 1. The exposing unit 3 illuminates the charged surface of the photoconductive body 1 in accordance with print data, thereby forming an electrostatic latent image on the photoconductive body 1. The toner supplying roller 8 supplies the toner 4, which is received from the toner cartridge 5, to the developing roller 6. The developing blade 7 forms a thin layer of toner on the developing roller 6. The developing roller 6 supplies the toner 4 to the photoconductive body 1, thereby developing the electrostatic latent image with the toner 4 into a toner image. The transfer roller 12 transfers the toner image onto the recording paper by the Coulomb force. The cleaning blade 9 scrapes the residual toner off the photoconductive body 1, the residual toner being collected in the waste toner collecting section 56.

Figure 9:
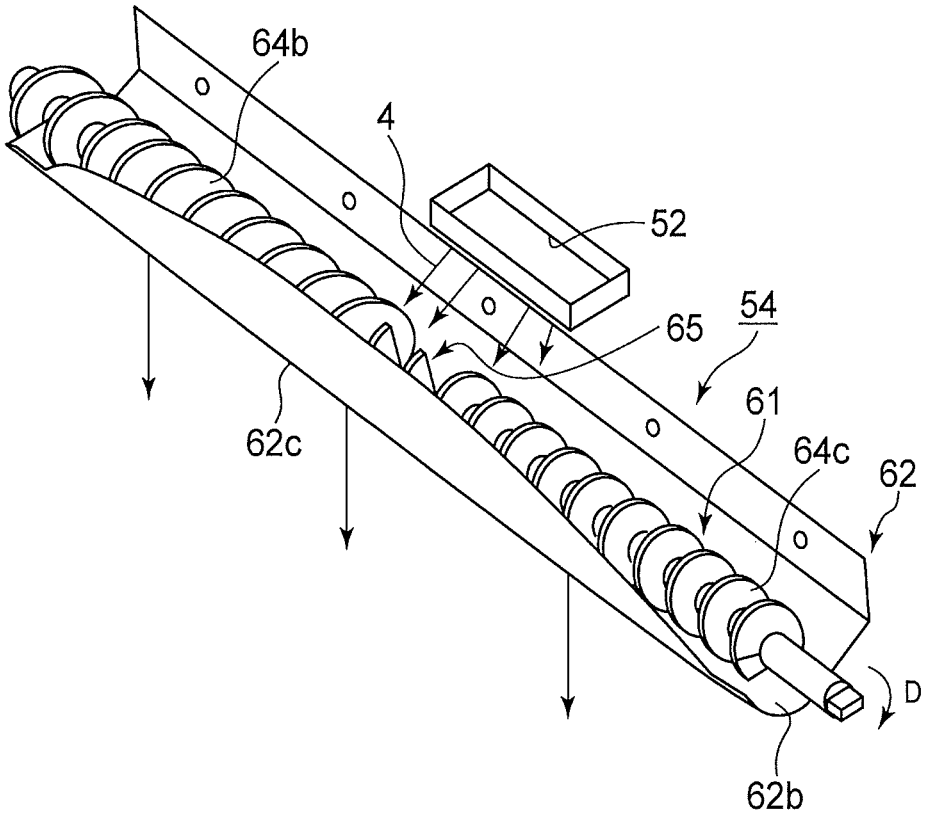
FIG. 9 is a perspective view of a pertinent portion of the toner distributor.
Figure 10:
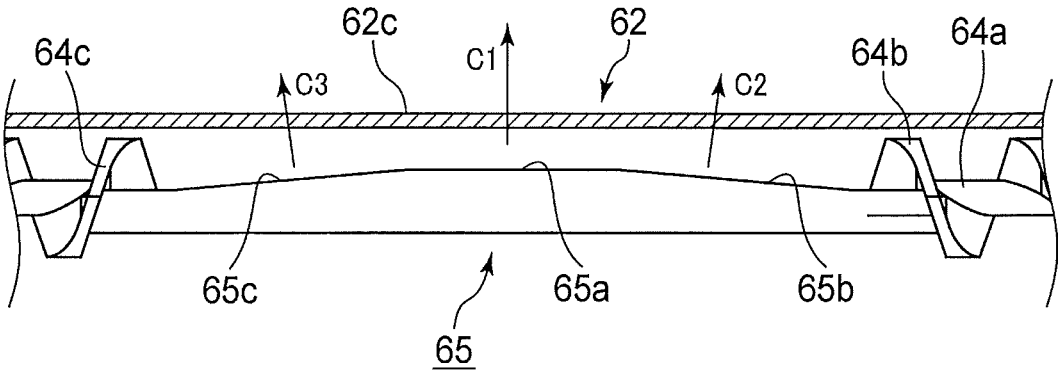
FIG. 10 is a partial top view of the toner agitator and the toner guide.

The toner distributor 54 receives the toner 4 from the toner cartridge 5, and distributes the toner 4 in the toner chamber 53. FIG. 9 is a perspective view of a pertinent portion of the toner distributor 54. FIG. 10 is a partial top view of the toner agitator 65 and the toner guide 62. The operation of the toner distributor 54 will be described with reference to FIGS. 9 and 10.

Referring to FIG. 9, the toner 4 is discharged from the toner cartridge 5, and falls onto the toner agitator 65 located under the toner discharging opening 52.

The toner transporting spiral 61 is driven in rotation by a drive source (not shown), so that the left-turn spiral 64*b* transports the toner 4 toward one of longitudinal ends of the toner transporting spiral 61 and the right-turn spiral 64*c* transports the toner 4 toward the other of longitudinal ends of the toner transporting spiral 61. When toner transporting spiral 61 rotates in a direction shown by arrow D (FIG. 9), the toner agitator 65 rotates in such a direction as to move the toner 4 from the bottom portion 62*b* to the barrier wall 62*c* while sliding the bottom 62*b*.

Referring to FIG. 10, the middle portion 65*a* and slanted portions 65*b* and 65*c* cooperate with each other to push up the toner 4 in directions shown by arrows C1, C2, and C3 along the inner surface of the toner guide 62.

The middle portion 65*a* pushes the toner 4 in the C1 direction, so that the toner 4 moves along the circumferential surface of the bottom 62*b*, a fraction of the toner 4 climbs over the middle portion of the barrier wall 62*c*, and falls into the toner chamber 53.

The slanted portion 65*b* pushes the toner 4 in the C2 direction, so that the toner 4 moves along the circumferential surface of the bottom 62*b*. A fraction of the toner climbs over the middle portion of the barrier wall 62*c*, falling into the toner chamber 53. The remaining portion of the toner 4 is further advanced toward one longitudinal end.

The slanted portion 65*c* pushes the toner 4 in the C3 direction, so that the toner 4 moves along the circumferential surface of the bottom 62*b*. A fraction of the toner 4 climbs over the middle portion of the barrier wall 62*c*, and falls into the toner chamber 53. The remaining portion of the toner 4 is further advanced toward another longitudinal end.

In this manner, the toner 4 falls from the toner receiving opening 52 onto the middle portion of the toner distributor 54, and is then advanced mainly in the longitudinal direction of the tone transporting spiral and partially in the circumferential direction of the toner guide 62. The force to move the toner 4 along the circumferential direction of the bottom 62*b* of the toner guide 62 is largest in the vicinity of the mid-point P of the toner guide 62, and decreases with increasing distance from the mid-point.

The height of the barrier wall 62*c* decreases nearer the longitudinal ends of the toner guide 62. In other words, the height is substantially proportional to the force acting on the toner 4 in the circumferential direction of the bottom 62*b*. Thus, the amount of toner, which climbs over the barrier wall 62*c* and falls into the toner chamber 53, is substantially uniform in the longitudinal direction of the toner guide 62.

The operation of the toner agitator 65 will be further described.

Figure 11:
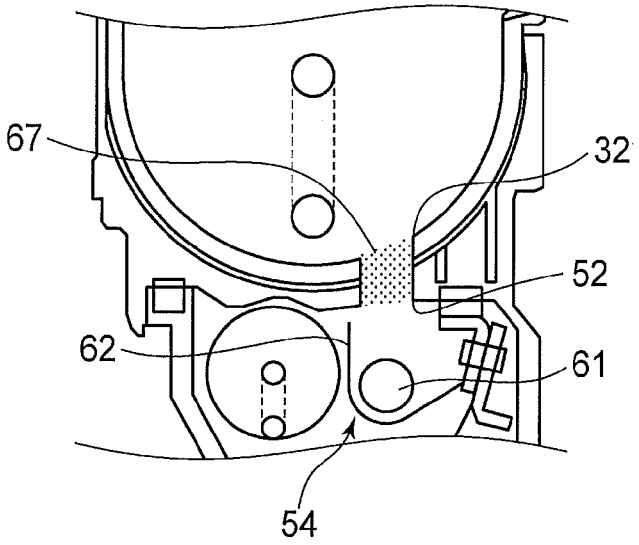
FIG. 11 is a cross-sectional view, illustrating a toner agglomeration that occurs at an area between a toner discharging opening and the toner receiving opening.

FIG. 11 is a cross-sectional view, illustrating a toner agglomeration 67 that occurs at an area between the toner discharging opening 32 and the toner receiving opening 52. FIGS. 12A and 12B illustrate the operation of the toner agitator 65.

If an amount of toner 4 supplied from the toner cartridge 5 is relatively large, the toner 4 may agglomerate in the area between the toner receiving opening 52 and the toner discharging opening 32. When the toner transporting spiral 61 rotates, the toner agitator 65 flexes and rotates while sliding on the inner surface of the toner chamber 53 and the toner guide 62.

Once the free end of the toner agitator 65 reaches an area immediately under the toner receiving opening 52, the toner agitator 65 resiliently regains its original shape, so that the toner agitator 65 resiliently extends upwardly into the toner receiving opening 52 and slaps or shakes off the toner 4 that clings to the walls defining the toner receiving opening 52. In this manner, agglomeration of toner 4 can be prevented, and the toner particles clinging to the walls fall into the toner chamber 53 promptly.

The toner agitator 65 rotates while also flexing and rubbing the inner surface of the toner guide 62 as shown in FIG. 12B. The middle portion 65*a* and slanted portions 65*b* and 65*c* effectively move the toner 4 away from the midpoint P in the circumferential direction of the toner transporting spiral 61 and in the longitudinal direction of the toner guide 62.

A description will be given of a comparison toner transporting spiral 561, which has only a toner agitator 565*a* and does not have the slanted portions 65*b* and 65*c* inclined by an angle θ with respect to the middle portion 65*a*.

Figure 13A:
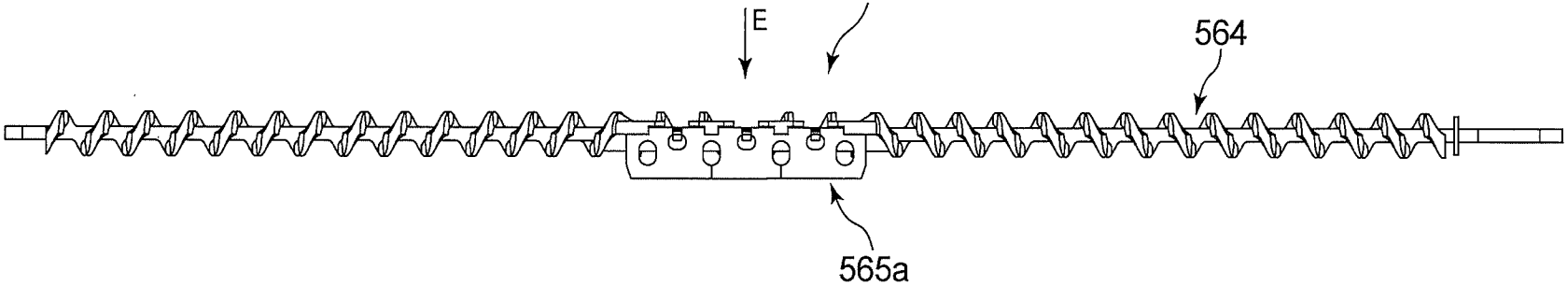
FIG. 13A is a top view of a comparison toner transporting spiral as seen in a direction normal to the major surface of the middle portion of the toner agitator.
Figure 13B:
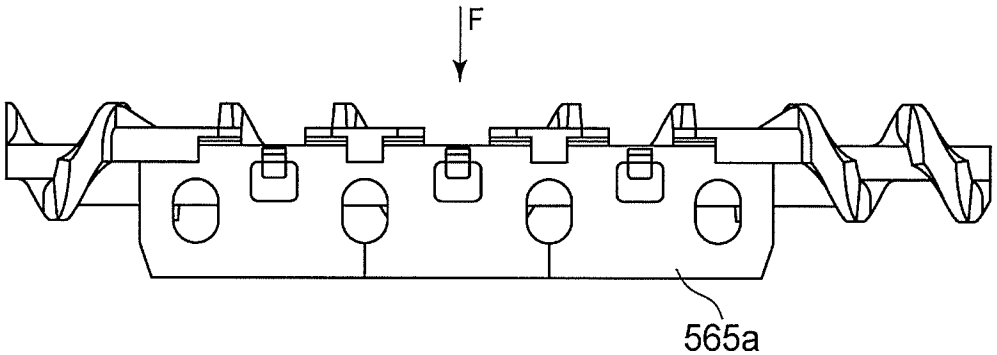
FIG. 13B is an expanded view of a pertinent portion of a comparison toner agitator.
Figure 14A:
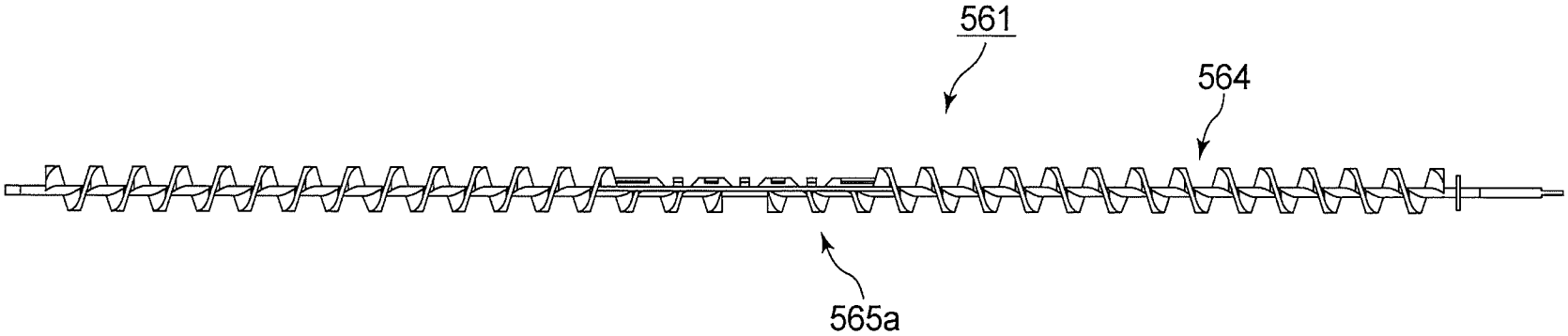
FIG. 14A is a top view as seen in a direction shown by arrow E in FIG. 13A.
Figure 14B:
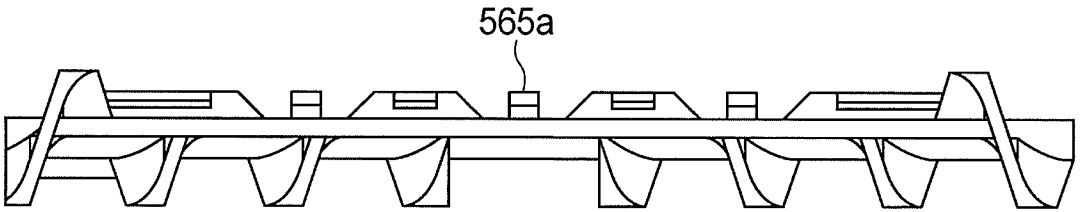
FIG. 14B is a top view as seen in a direction shown by arrow F in FIG. 13B.
Figure 15:
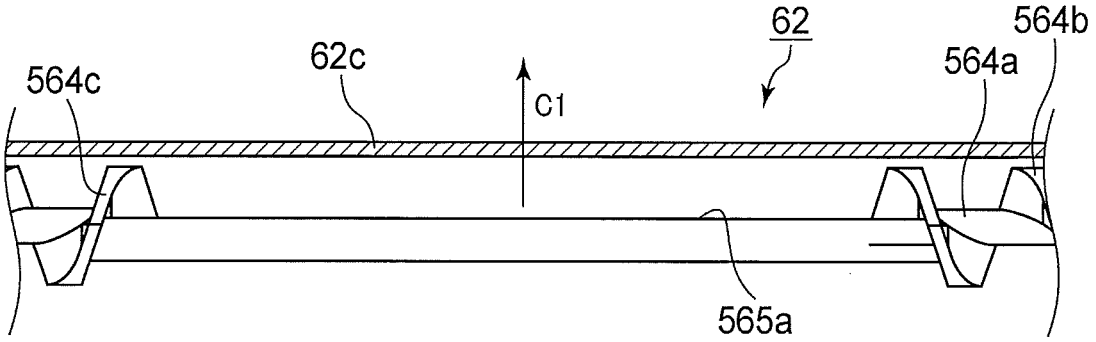
FIG. 15 is a top view of a pertinent portion of the comparison toner agitator and the toner guide.

FIG. 13A is a top view of the toner transporting spiral 560 as seen in a direction normal to the major surface of the toner agitator 565*a*. FIG. 13B is an expanded view of a pertinent portion of the toner agitator 565*a*. FIG. 14A is a top view as seen in a direction shown by arrow E in 13A. FIG. 14B is a top view as seen in a direction shown by arrow F in 13B. FIG. 15 is a top view of a pertinent portion of the comparison toner agitator 565*a* and the toner guide 62.

Referring to FIGS. 13A, 13B, 14A and 14B, the comparison toner agitator 565 includes only a portion 565*a* that extends parallel to the rotational axis of the toner transporting spiral 561, and does not have slanted portions as opposed to the first embodiment. As shown in FIG. 15, the toner 4 falls from the toner receiving opening 52 onto the toner agitator 565. As the toner transporting spiral 561 rotates, the toner agitator 565*a* pushes the toner 4 in the circumferential direction along the inner surface of the toner guide 62 as shown by arrow C1.

Just as in the toner agitator 65 according to the first embodiment, when the comparison toner agitator 565*a* rotates and passes the toner receiving opening 52, the comparison toner agitator 565*a* resiliently regains its original shape and extends into the toner receiving opening 52 in the same manner as shown in FIGS. 12A and 12B. Thus, the comparison toner agitator 565*a* also shakes the toner particles clinging to the wall defining the toner receiving opening 52. However, since the comparison toner agitator 565*a* pushes the toner 4 only in the circumferential direction along the inner surface of the toner guide 62 and cannot not move or push the toner 4 in the longitudinal direction of the toner guide 62.

As described above, in the first embodiment, the toner 4 is prevented from being agglomerated in the vicinity of the toner discharging opening 32 and the toner receiving opening 52, thereby ensuring reliable supply of toner 4 into the toner chamber 53. This configuration prevents printed images from becoming fainted. The toner 4 is transported toward the longitudinal ends of the toner guide 62 along the barrier wall, ensuring uniform distribution of toner 4 in the longitudinal direction of the toner chamber 53 and offering uniform print quality over a long time.

Second Embodiment

Figure 16:
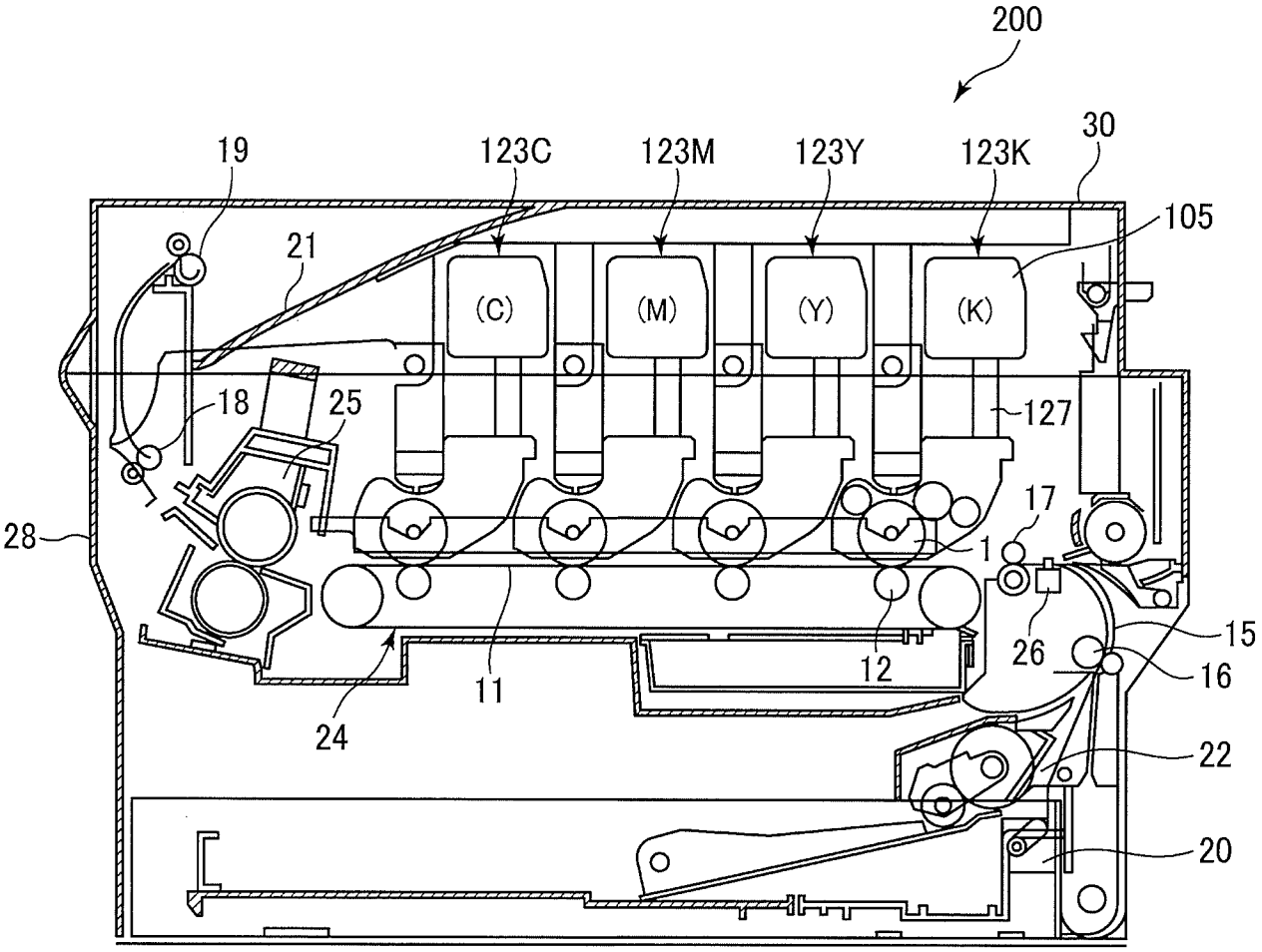
FIG. 16 illustrates the outline of an image forming apparatus according to a second embodiment of the invention.
Figure 17:
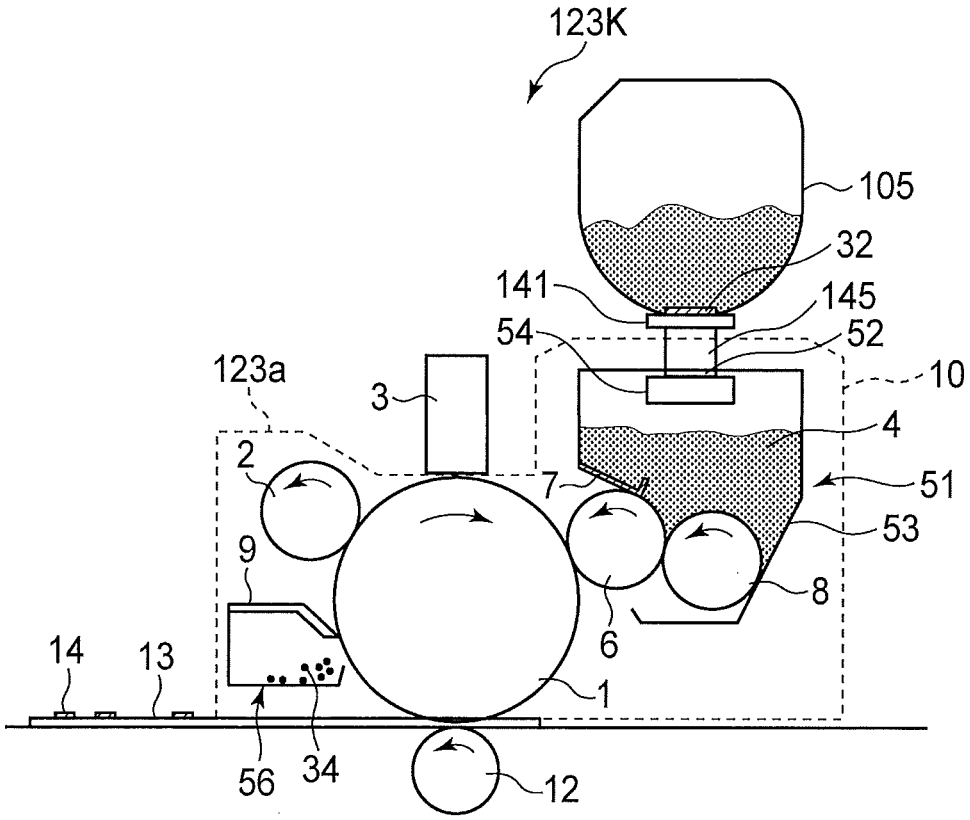
FIG. 17 illustrates the outline of an image forming unit for forming black images according to the second embodiment.

FIG. 16 illustrates the outline of an image forming apparatus 200 according to a second embodiment of the invention. FIG. 17 illustrates the outline of the image forming unit 123K for forming black images. The image forming unit 23K includes a transfer belt 11, a transfer roller 12, an exposing unit 3, and a sheet of recording paper 13.

The image forming apparatus 200 differs from the image forming apparatus 100 in that a toner cartridge 5 is attached to a developing unit 123*a* through a toner path 145 and a cartridge support 141. Elements similar to those of the image forming apparatus 100 have been given the same reference numerals, and their description is omitted.

In the first embodiment, the toner cartridge 5 is directly attached to the body 23*a* so that the toner discharging opening 32 simply faces the toner receiving opening 52 as shown in FIG. 5. In contrast, the toner cartridge 105 of the second embodiment communicates with the body 23*a* through the toner path 145 and cartridge support 141.

The toner cartridge 5 is detachably attached to the cartridge support 141, so that the toner 4 is supplied to the body 123*a* through the toner discharging opening 32, the cartridge support 141, the toner path 145, and the toner receiving opening 52. The cartridge support 141, the toner path 145, and the toner receiving opening 52 are located on the body 123*a*.

The toner 4 falls onto the longitudinally middle portion of a toner distributor 54 disposed directly under the toner receiving opening 52. The tone distributor 54 moves the toner 4 in longitudinal opposite directions in which the toner chamber 53 extends. The toner 4 falls little by little into the toner chamber 53 as the toner 4 moves along a toner guide 62. Thus, the toner 4 is substantially uniformly distributed in the longitudinal direction of the toner chamber 53.

As described above, the second embodiment provides the same effects as the first embodiment. In addition, the second embodiment offers freedom in mounting the toner cartridge 5 on the body 123*a*, lending itself to a variety of configurations of image forming apparatus.

The first and second embodiments have been described with respect to a color electrophotographic printer. The present invention is not limited to this, and may be applicable to image forming apparatus including a copying machine, a facsimile machine, and a multi-function printer (MFP) in which images are formed on a recording medium by electrophotography. The image forming apparatus may be a color printer or a monochrome printer.

The invention being thus described, it will be obvious that the same may be varied in many ways. Such variations are not to be regarded as a departure from the scope of the invention, and all such modifications as would be obvious to one skilled in the art are intended to be included within the scope of the following claim.

What is claimed is:

1. A developing unit, comprising:

a chamber that holds a developer material therein and includes a receiving opening for receiving the developer material from an external device;

a guide member disposed in the chamber directly under the receiving opening, the guide member supporting the developer material which falls from the receiving opening, extending in a first direction, and guiding the developer material in the first direction;

a transporting member disposed between the receiving opening and the guide member, the transporting member extending in a second direction parallel to the first direction, being rotatable about a rotational axis in the second direction, and transporting the developer material on the guide member in the second direction; and an agitator located on the transporting member and in an area facing the receiving opening, the agitator including:

a middle portion extending in a plane substantially parallel to the transporting member and lying substantially at a longitudinally middle portion of the transporting member; and a slanted portion contiguous with and extending away from the middle portion, the slanted portion extending along the transporting member and being inclined relative to the rotational axis of the transporting member, wherein a distance between the slanted portion and the rotational axis of the transporting member decreases in a direction from the longitudinally middle portion toward a longitudinally end portion of the transporting member.

2. The developing unit according to claim 1, wherein the transporting member includes a rotational shaft that extends in the second direction, and the slanted portion includes two slanted portions contiguous with and extending away from and on opposite sides of the middle portion, each slanted portion extending at an angle with and substantially along the rotational shaft in opposite directions, wherein distance between each slanted portion and the rotational shaft decreases in a direction from the longitudinally middle portion toward a respective longitudinally end portion of the transporting member.

3. The developing unit according to claim 2, wherein the middle portion and the two slanted portions are aligned in a direction substantially parallel to the rotational shaft with the middle portion positioned between the two slanted portions, the two slanted portions extending away from the middle portion in opposite directions.

4. The developing unit according to claim 3, wherein the agitator is positioned substantially at a longitudinal mid-point of the transporting member, and the guide member includes (i) a bottom that circumferentially extends and partially surrounds the transporting member, and (ii) a wall contiguous with the bottom, the wall extending in a third direction parallel to the first direction, the wall being highest in a vicinity of the longitudinal mid-point of the transporting member, and being lower nearer the longitudinal ends of the guide member.

5. The developing unit according to claim 2, wherein the agitator includes a slit formed between the middle portion and each of the two slanted portions.

6. The developing unit according to claim 2, wherein the transporting member includes a first spiral region on which a first spiral screw with a first direction of spiral is formed and a second spiral region on which a second spiral screw with a second direction of spiral is formed.

7. The developing unit according to claim 2, wherein the agitator is formed of a flexible material, and extends over a first distance in a direction substantially perpendicular to the rotational shaft when the agitator extends toward the receiving opening, the first distance being longer than a second distance between the rotational shaft and the receiving opening.

8. The developing unit according to claim 7, wherein the agitator is in the shape of a film.

9. The developing unit according to claim 2, wherein the angle is substantially 5 degrees.

10. An image forming unit incorporating the developing unit according to claim 1, the image forming unit comprising:

a developer material cartridge attached on the developing unit and supplying the developer material into the chamber through the receiving opening.

11. An image forming apparatus incorporating the image forming unit according to claim 10, wherein the image forming unit is detachably attached to the image forming apparatus.

12. An image forming apparatus incorporating the developing unit according to claim 1 so that the developing unit is detachably attached to the image forming apparatus, the image forming apparatus comprising:

a developer material cartridge detachably attached to the image forming apparatus; and a developer path that connects the receiving opening and a developer discharging opening of the developer material cartridge, and that defines a path through which the developer material is supplied from the developer material cartridge into the chamber.

13. The developing unit according to claim 1, further comprising fixing portions that hold the agitator in such a manner that the fixing portions sandwich the agitator there between.

14. The developing unit according to claim 1, wherein the agitator includes a flat surface portion disposed in the area facing the receiving opening, and wherein the slanted portion pushes the developer material from the flat surface portion toward an end of the transporting member in the second direction.

15. The developing unit according to claim 1, wherein the transporting member includes a rotational shaft on which a spiral screw is provided, and wherein distance between the slanted portion and the rotational shaft decreases with increase in distance along the second direction from the middle portion toward the longitudinally end portion of the transporting member.

* * * * *